US006209635B1

(12) United States Patent
Gotlib et al.

(10) Patent No.: US 6,209,635 B1
(45) Date of Patent: Apr. 3, 2001

(54) POSITIONING AND CONVEYING WELL APPARATUS AND METHOD

(75) Inventors: Mikhail Gotlib; Herve Ohmer; Mark W. Brochman, all of Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 09/690,158

(22) Filed: Oct. 17, 2000

Related U.S. Application Data

(60) Provisional application No. 60/160,236, filed on Oct. 18, 1999.

(51) Int. Cl.[7] ..... E21B 7/08

(52) U.S. Cl. ..... 166/117.5; 166/117.6; 166/374; 175/80

(58) Field of Search ..... 166/117.5, 117.6, 166/217, 212, 125, 374, 378; 175/80, 81, 79

(56) References Cited

U.S. PATENT DOCUMENTS 4,411,316 * 10/1983 Carmody ..... 166/323
4,726,421 * 2/1988 Akkerman et al. ..... 166/117.5
5,909,770 * 6/1999 Davis ..... 166/117.6
6,050,334 * 4/2000 McGarian et al. ..... 166/117.6

FOREIGN PATENT DOCUMENTS

2157741 * 10/1985 (GB) .

* cited by examiner

*Primary Examiner*—Frank S. Tsay
(74) *Attorney, Agent, or Firm*—Jeffrey E. Griffin

(57) ABSTRACT

In a broad aspect, the invention may include a nipple, a deflector, and a conveying tool. The nipple may include an upper sealing surface and a lower sealing surface. The nipple may also include a discriminator/muleshoe having an alignment profile and an alignment slot. A protuberance/bump may be disposed in the alignment slot. The deflector may include an upper seal and a lower seal adapted for engagement with the upper and lower sealing surfaces, respectively, on the nipple. When the upper and lower seals are engaged with the upper and lower sealing surfaces, fluid circulation is substantially restricted thereby resulting in a increase in pressure that is detectable at the earth's surface. This pressure increase provides a signal that the deflector is properly positioned in the nipple. The conveying tool may include a flexible arm having a latching finger that is releasably engageable with a latching profile in the deflector. The latching profile may be on an inclined, concave surface of a whipstock. Related methods are also provided.

38 Claims, 10 Drawing Sheets

Fig. 1
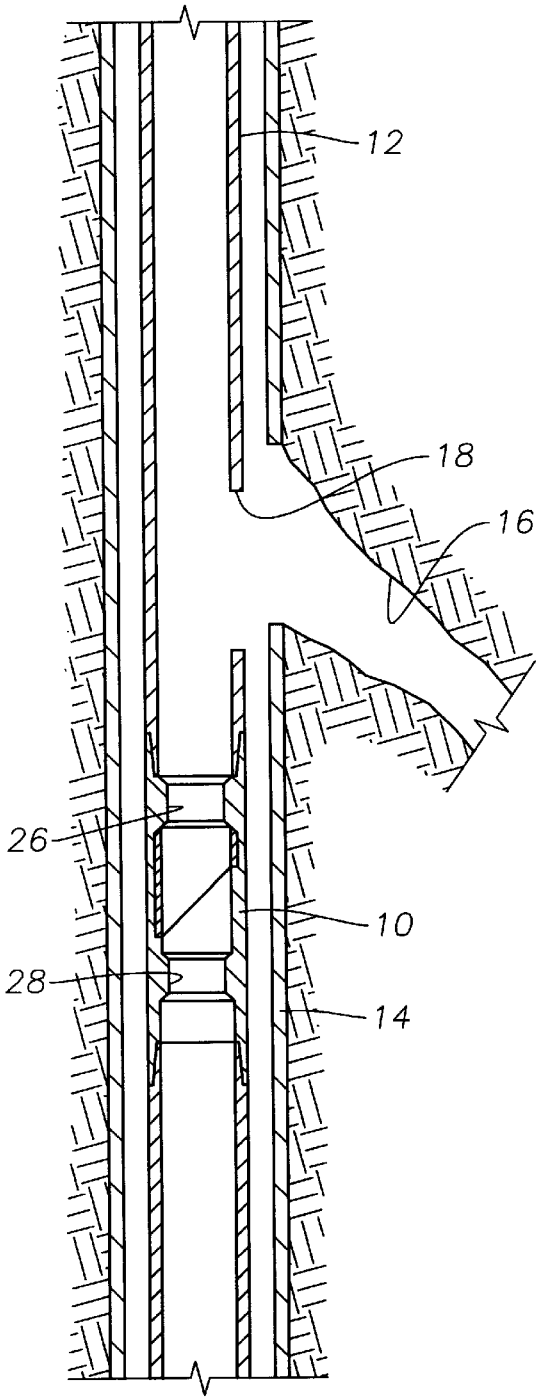
Fig. 2
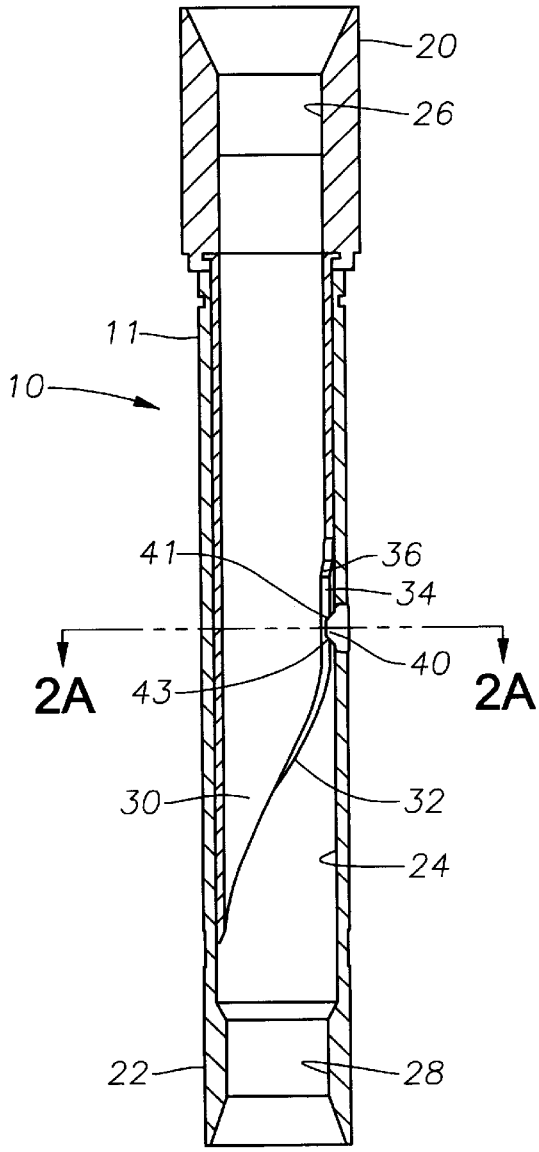
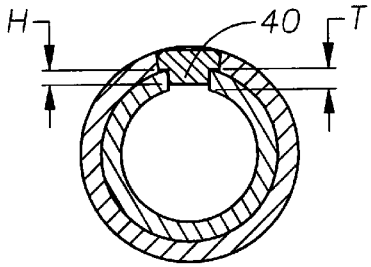
Fig. 2A

POSITIONING AND CONVEYING WELL APPARATUS AND METHOD

RELATED APPLICATIONS

This application claims the benefit of U.S. Provisional Application No. 60/160,236, filed Oct. 18, 1999.

BACKGROUND OF THE INVENTION

1. Field of the Invention

The present invention relates to subsurface well equipment and, more particularly, to devices and related methods for determining the position of subsurface well equipment within a well.

2. Description of the Related Art

Wells having one or more lateral branches extending therefrom are now commonplace in the petroleum-exploration industry. It is customary that it is desirable to enter one or more of the lateral branches with a some type of work or tool string. It is known that a deflecting device have an inclined surface (often called a "whipstock") is used divert the string into the desired lateral, and that the whipstock must be remotely oriented and set in the well bore adjacent the lateral branch into which tool entry is desired. This is often accomplished by use of one or more locating and orienting keys on the whipstock that cooperate with an orienting profile and alignment slot in the well near the desired lateral branch. A problem that exists in this scenario is that current technology does not give a sufficiently reliable indication to an operator at the earth's surface that the whipstock has been properly landed in the alignment slot. In this regard, the current approach to determining whether the whipstock is properly landed is to compare the tension or compression on the string to the length of the string. This is not considered reliable for either coiled tubing or jointed pipes. The accuracy of this approach for coiled tubing is approximately ±50 feet and for jointed pipe approximately ±10 feet. With these margins of error, the whipstock could be stuck in the wrong place within the well several feet above or below the mating profile, but the surface indication would be that it was properly landed in the correct location.

SUMMARY OF THE INVENTION

The present invention has been contemplated to meet the above described needs. In one aspect, the present invention provides a system for determining that a locking or locating device is positioned at a predetermined mating profile in a string, independent of linear measurements or conventional compression/tension gauges. This may be accomplished by substantially restricting circulation through a fluid circulation port located between two seals once the seals are positioned across sealing surfaces inside a mating nipple. The present invention may also include a conveying tool with a flexible arm that is clipped or clamped to a dedicated pocket on or near the inclined surface of the whipstock. The flexible arm is supported by a piston disposed for movement within the conveying tool. Some advantages of the conveying tool of the present invention are that all shifting parts are on the conveying tool side, the outside diameter of the whipstock may be maximized, and the whipstock inclined surface is not obstructed with a large opening. The apparatus of the present invention is conveyed inside the string on coiled tubing or jointed pipe. Additional aspects of the present invention will be summarized here and then more fully described under the detailed-description heading.

In one aspect, the invention may be a downhole well tool comprising: a nipple connected to a well conduit, the nipple including a longitudinal bore having an upper sealing surface and a lower sealing surface; a body member having an upper seal, a lower seal, and a fluid passageway extending from an upper end of the body member and exiting the body member between the upper and lower seals; and a key remotely shiftable between a running position and a locked position, the key being releasably engageable with the nipple when in its locked position, and the upper and lower seals being engaged with the upper and lower sealing surfaces, respectively, when the key is in its locked position, thereby substantially restricting fluid circulation through the fluid passageway in the body member and increasing fluid pressure therein. Another feature of this aspect of the present invention is that the key is engageable with an alignment profile in the nipple to rotate the well tool to a predetermined orientation. Another feature of this aspect of the present invention is that the key is releasably engageable with a protuberance disposed in an alignment slot in the nipple. Another feature of this aspect of the present invention is that the tool may further include a conveying tool having: a body with a longitudinal bore therethrough; a flexible arm extending from the body, a distal end of the arm having a latching finger; and a release piston disposed within the longitudinal bore and releasably attached to the body when in a locked position, the release piston having a shoulder adapted to maintain locking engagement between the latching finger on the flexible arm and a latching profile on the body member of the downhole well tool when the release piston is in its locked position, the release piston being shiftable within the longitudinal bore upon disengagement from the body to disengage the latching finger from the latching profile. Another feature of this aspect of the present invention is that the longitudinal bore further includes an upper seat and a lower seat, a diameter of the upper seat being greater than a diameter of the lower seat, the piston further including a fluid port disposed through a wall of the piston and between the upper and lower seats, the conveying tool further including a first ball engageable with the lower seat and adapted to divert fluid flow through the fluid port, an d a second ball engageable with the upper seat and adapted to restrict fluid flow through the longitudinal bore of the piston. Another feature of this aspect of the present invention is that the conveying tool further includes a sleeve extending from the body of the conveying tool and adapted to be disposed about an outside diameter of the body member of the downhole well tool.

In another aspect, the present invention may be a downhole well tool comprising: a nipple connected to a well conduit, the nipple including a longitudinal bore having an upper scaling surface and a lower sealing surface; a body member having an upper seal and a lower seal; a whipstock having an upper end, a lower end, an inclined surface at the upper end, a first fluid passageway extending longitudinally through the whipstock, a second fluid passageway extending from the lower end of the whipstock to an exit port disposed above the upper seal, and a third fluid passageway extending from the upper end of the whipstock to a piston chamber; a key piston releasably attached to the body member, adapted for movement upon disengagement from the body member, and in fluid communication with the third fluid passageway; and a key connected to the body member and remotely shiftable between a running position and a locked position, the key being releasably engaged with the nipple when in its locked position, the key being maintained in its running position by releasable engagement with the key piston, and the upper and lower scals being engaged with the upper and lower sealing surfaces, respectively, when the key is in its locked position, thereby substantially restricting fluid circulation through the third fluid passageway and increasing fluid pressure therein. Another feature of this aspect of the present invention is that the key is engageable with an alignment profile in the nipple to rotate the well tool to a predetermined orientation. Another feature of this aspect of the present invention is that the key is releasably engageable with a protuberance disposed in an alignment slot in the nipple. Another feature of this aspect of the present invention is that the key includes a first and a second diverging surface engageable with a first and a second inclined surface in the alignment slot in the nipple. Another feature of this aspect of the present invention is that the key includes a head with an arm extending therefrom, the arm having a slot extending from the head towards a distal end of the arm and terminating at an inclined surface, and wherein the whipstock further includes a support shoulder and a hook, the support shoulder being adapted to hold the key in its locked position, and the hook being releasably engageable with the inclined surface on the key arm to retract the key to its running position. Another feature of this aspect of the present invention is that at least one of the hook and support shoulder is adapted to be received within the arm slot. Another feature of this aspect of the present invention is that the key does not extend beyond an outside diameter of the body member when the key is in its running position. Another feature of this aspect of the present invention is that the tool may further include a collet and a locking piston, the collet being connected to the body member and having at least one collet finger releasably engageable with a groove in the whipstock, the locking piston being releasably attached to the body member when in a locked position, and having an upper portion disposed between the collet finger and the body member when in the locked position to lock the collet finger in the whipstock groove, thereby restricting movement of the whipstock relative to the body member when the locking piston is in its locked position. Another feature of this aspect of the present invention is that the tool may further include a sleeve and a resilient lock ring, the sleeve being disposed about and releasably secured to the whipstock and having an annular groove about its periphery, the lock ring being disposed about the sleeve and within an annular recess in the body member when collet finger is locked in the whipstock groove, and the lock ring being disposed within the annular recess and annular groove after the locking piston is released from the body member to disengage the collet finger from the whipstock groove and permit the whipstock to shift upwardly relative to the body member. Another feature of this aspect of the present invention is that the tool may further include a conveying tool having: a body with a longitudinal bore therethrough; a flexible arm extending from the body, a distal end of the arm having a latching finger; and a release piston disposed within the longitudinal bore and releasably attached to the body when in a locked position, the release piston having a shoulder adapted to maintain locking engagement between the latching finger on the flexible arm and a latching profile on the whipstock when the release piston is in its locked position, the release piston being shiftable within the longitudinal bore upon disengagement from the body to disengage the latching finger from the latching profile. Another feature of this aspect of the present invention is that the longitudinal bore further includes an upper seat and a lower seat, a diameter of the upper seat being greater than a diameter of the lower seat, the piston further including a fluid port disposed through a wall of the piston and between the upper and lower seats, the conveying tool further including a first ball engageable with the lower seat and adapted to divert fluid flow through the fluid port and into third fluid passageway in the whipstock, and a second ball engageable with the upper seat and adapted to restrict fluid flow through the longitudinal bore of the piston. Another feature of this aspect of the present invention is that the conveying tool further includes a sleeve extending from the body and adapted to be disposed about an outside diameter of the whipstock.

In yet another aspect, the present invention may be a downhole positioning system for use in a well conduit, the system comprising: a nipple connected to the well conduit and having a longitudinal bore with an upper scaling surface and a lower sealing surface disposed therein; a downhole well tool having a body member and a key, the body member having an upper seal, a lower seal, and a fluid passageway extending from an upper end of the body member and exiting the body member between the upper and lower seals, the key being remotely shiftable between a running position and a locked position, the key being releasably engageable with the nipple when in its locked position, and the upper and lower seals being engaged with the upper and lower sealing surfaces, respectively, when the key is in its locked position, thereby substantially restricting fluid circulation through the fluid passageway in the body member and increasing fluid pressure therein; and a conveying tool having a latching finger releasably engageable with a latching profile on the downhole well tool. Another feature of this aspect of the present invention is that the key is engageable with an alignment profile in the nipple to rotate the well tool to a predetermined orientation. Another feature of this aspect of the present invention is that the key is releasably engageable with a protuberance disposed in an alignment slot in the nipple. Another feature of this aspect of the present invention is that the key includes a first and a second diverging surface engageable with a first and a second inclined surface in the alignment slot in the nipple. Another feature of this aspect of the present invention is that the conveying tool further including: a body with a longitudinal bore therethrough; a flexible arm extending from the body, the latching finger being disposed at a distal end of the arm; and a release piston disposed within the longitudinal bore and releasably attached to the body when in a locked position, the release piston having a shoulder adapted to maintain locking engagement between the latching finger on the flexible arm and a latching profile on the body member of the downhole well tool when the release piston is in its locked position, the release piston being shiftable within the longitudinal bore upon disengagement from the body to disengage the latching finger from the latching profile.

In still another aspect, the present invention may be a system for verifying well position, the system comprising: a nipple connected to a well conduit and having at least one sealing surface; a well tool having an upper end, a lower end, at least one seal, and a fluid passageway extending from the upper end of the well tool to an exterior of the well tool, the at least one seal and the at least one sealing surface providing a well seal when aligned, the well seal substantially restricting fluid communication from the fluid passageway and the well conduit beyond the upper and lower ends of the well tool. Another feature of this aspect of the present invention is that the nipple includes two sealing surfaces, the well tool includes two seals, and the fluid passageway communicating with the exterior of the well exits the well tool between the two seals.

In yet another aspect, the present invention may be a well tool, comprising: a body member; a key attached to the body member, the key moveable between a retracted position and a deployed position; a retaining member selectively holding the key in the retracted position and releasable to allow the key to move to a deployed position; and a retracting member moveable to selectively move the key from the deployed position to the retracted position.

In another aspect, the present invention may be an apparatus for conveying a well tool to a desired location, comprising: a body member having a longitudinal bore therethrough; a flexible arm extending from the body member and having a latching finger at a distal end thereof, the latching finger being releasably engageable with a latching profile on the well tool; and a release piston having an upper end, a lower end, a longitudinal bore therethrough, and an annular shoulder adapted to closely fit and move within the longitudinal bore of the body member, the piston being releasably secured to the body member when the piston is in a running position, the annular shoulder being disposed within the longitudinal bore of the body member when the piston is in its running position to maintain engagement between the latching finger and latching profile. Another feature of this aspect of the present invention is that the arm is biased towards the longitudinal bore. Another feature of this aspect of the present invention is that the release piston further includes a fluid port located through a piston wall and between the upper and lower seats. Another feature of this aspect of the present invention is that the piston bore includes an upper seat and a lower seat, the diameter of the upper seat being greater than the diameter of the lower seat. Another feature of this aspect of the present invention is that the apparatus may further include a sleeve member extending from the body member and adapted for engagement about the well tool.

In another aspect, the present invention may be a downhole well tool comprising: a nipple connected to a well conduit, the nipple including a longitudinal bore having an upper sealing surface and a lower sealing surface; a body member having an upper seal, a lower seal, and a fluid passageway extending from an upper end of the body member and exiting the body member between the upper and lower seals, the upper and lower seals being engaged with the upper and lower sealing surfaces, respectively, when the body member is locked to the nipple, thereby substantially restricting fluid circulation through the fluid passageway in the body member and increasing fluid pressure therein.

In another aspect, the present invention may be a downhole well tool comprising: a nipple connected to a well conduit, the nipple including a longitudinal bore having an upper sealing surface and a lower sealing surface; a body member having an upper seal, a lower seal, and a fluid passageway extending from an upper end of the body member and exiting the body member between the upper and lower seals, the upper and lower seals being engaged with the upper and lower sealing surfaces, respectively, thereby substantially restricting fluid circulation through the fluid passageway in the body member and increasing fluid pressure therein.

In another aspect, the present invention may be a method for determining the position of a downhole well tool within a well conduit, comprising: providing a nipple in the well conduit, the nipple having a longitudinal bore with an upper sealing surface and a lower sealing surface disposed therein; lowering the downhole tool into the well conduit; detecting fluid pressure between the upper and lower sealing surfaces; and determining whether an upper and lower seal on the downhole well tool are engaged with the upper and lower sealing surfaces, respectively. Another feature of this aspect of the present invention is that the method may further include attempting to engage a key on the downhole tool in an alignment slot in the nipple, between the lowering and detecting steps.

In another aspect, the present invention may be a method of providing position feedback of a well tool in a well to the earth's surface, the method comprising: running the well tool into the well; circulating fluid through the well tool to an exterior of the well tool; providing a nipple in the well at a predetermined position; sealing between the well tool and the nipple when the well tool is aligned with the nipple in the well and substantially restricting circulation of the fluid flow; and detecting the pressure of the flow of fluid to the well tool.

In another aspect, the present invention may be a method of selectively deploying a key in a well tool, the method comprising: retaining the key in a retracted position with a retaining member; releasing the retaining member; and moving the key from the retracted position to a deployed position. Another feature of this aspect of the present invention is that the method may further include subsequently moving the key from the deployed position to the retracted position.

BRIEF DESCRIPTION OF THE DRAWINGS

Other features and advantages of the present invention will become more fully apparent from the following detailed description, appended claims, and the accompanying drawings in which:

FIG. 1 is a longitudinal cross-sectional view showing a nipple of the present invention connected to a production tubing disposed within a well casing.

FIG. 2 is longitudinal cross-sectional view of the nipple shown in FIG. 1.

FIG. 2A is a cross-sectional view taken along line 2A—2A of FIG. 2.

Figure 3:
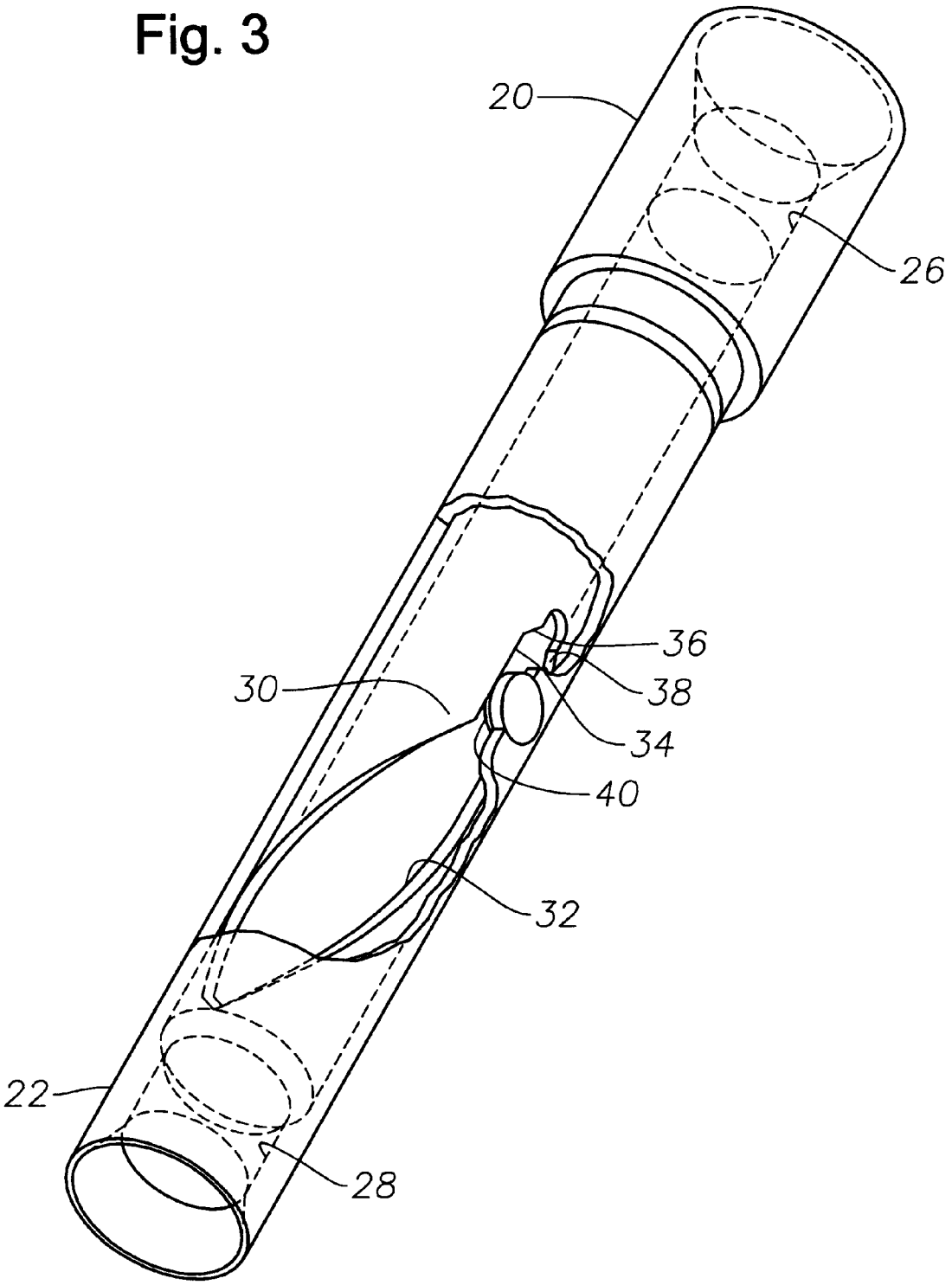
FIG. 3 is a perspective view of the nipple shown in FIGS. 1–2A.

While the invention will be described in connection with the preferred embodiments, it will be understood that it is not intended to limit the invention to those embodiments. On the contrary, it is intended to cover all alternatives, modifications, and equivalents as may be included within the spirit and scope of the invention as defined by the appended claims.

DETAILED DESCRIPTION OF THE INVENTION

In a broad aspect, the present invention may include three components: (1) a nipple; (2) a deflector; and (3) a deflector conveying tool. Referring to the drawings in detail, wherein like numerals denote identical elements throughout the several views, it can be seen with reference to FIG. 1 that the nipple 10 of the present invention may be connected to, or formed as part of, a production tubing 12 disposed within a well casing 14 having a lateral branch 16 extending therefrom. The production tubing 12 includes a window 18 disposed adjacent the lateral branch 16. The nipple 10 is more fully illustrated in FIGS. 2 and 3.

With reference to FIGS. 2, 2A and 3, the nipple 10 includes a body member 11 having an upper end 20, a lower end 22, and a longitudinal bore 24 therethrough. The bore 24 may include an upper sealing surface 26 and a lower sealing surface 28 (see also FIG. 1). The nipple 10 may further include a discriminator 30 (also sometimes referred to as a "muleshoe") that may be formed within the bore 24 or attached as a separate component within the bore 24. The discriminator 30 includes an alignment profile 32 and an alignment slot 34. The alignment slot 34 may further include a first inclined surface 36 and a second inclined surface 38. The body member 11 may further include a bump or protuberance 40 disposed within the discriminator slot 34. The bump 40 may be formed in the body member 11 or on an insert attached to the body member 11. With reference to FIG. 2, the bump 40 may include an upper inclined surface 41 and a lower inclined surface 43, the purpose of which will be explained below. As best seen in FIG. 2A, the height H of the bump 40 is less than the thickness T of the alignment slot 34 in the discriminator 30.

Figure 4A:
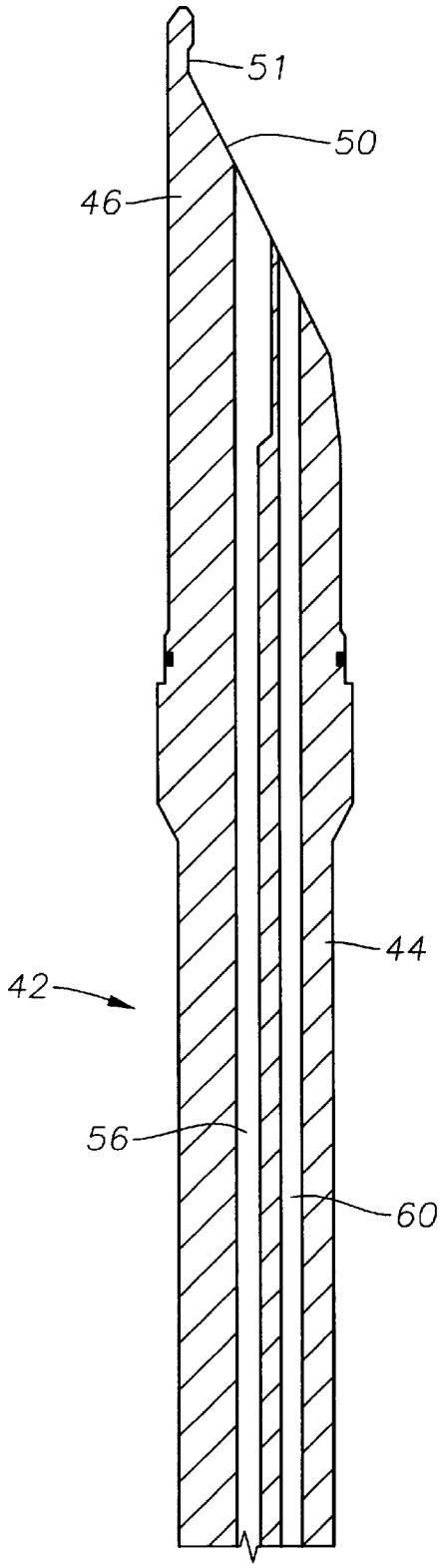
FIGS. 4A–4B, taken together, illustrate a longitudinal side view of a deflector of the present invention.
Figure 4B:
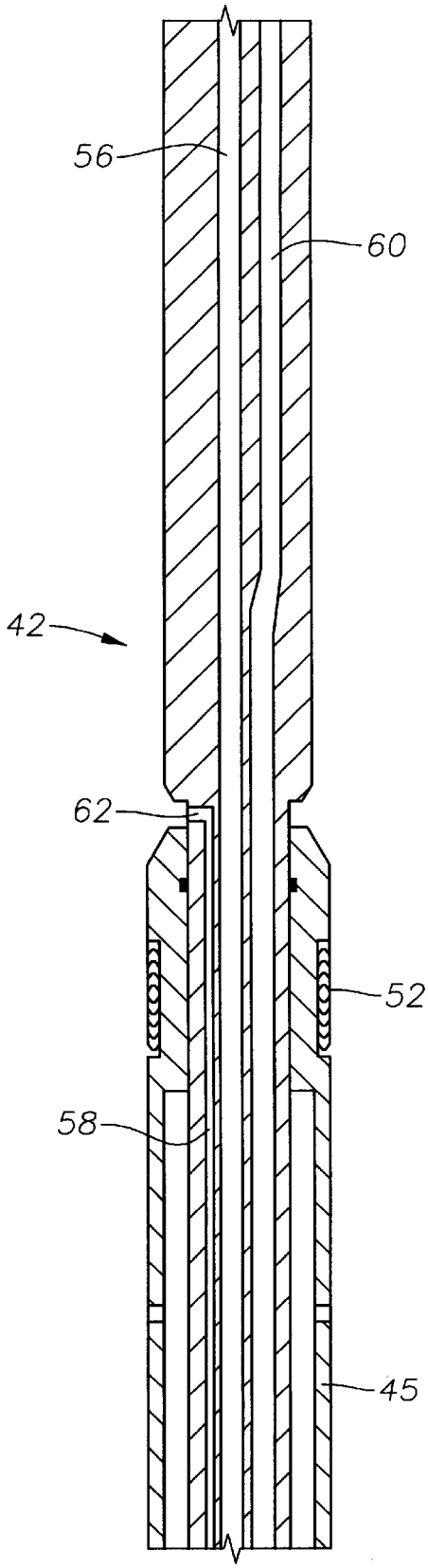
Figure 4C:
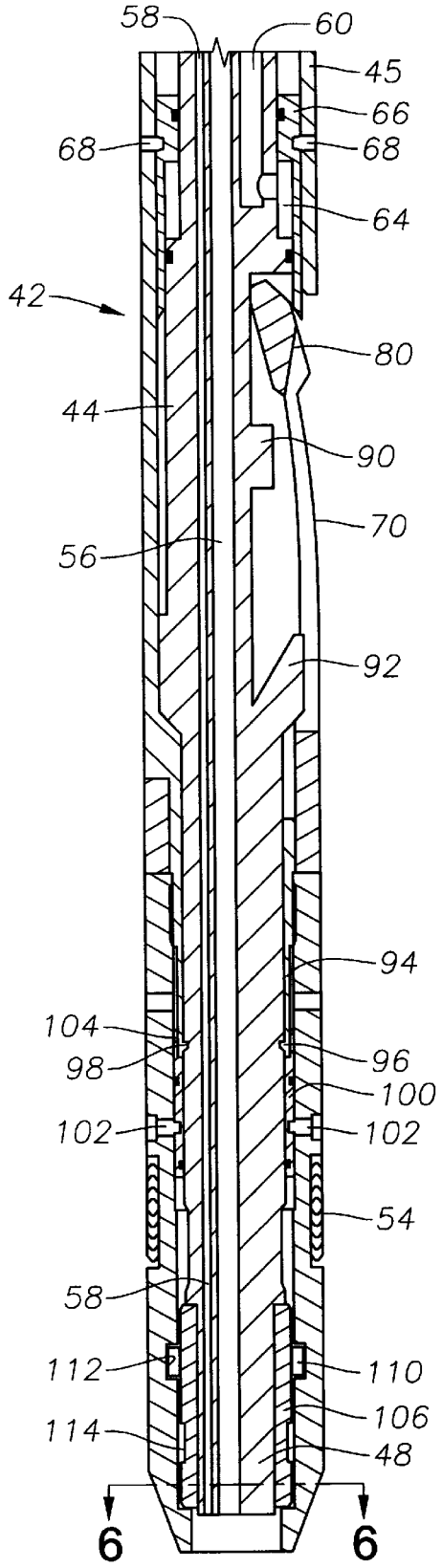

The second of the three above-identified main components of the present invention, i.e., the deflector, will now be described with reference to FIGS. 4A–4B, wherein the deflector is identified by the numeral 42. The deflector 42 includes a whipstock 44 and a body member 45. The whipstock 44 includes an upper end 46 (FIG. 4A) and a lower end 48 (FIG. 4B). The upper end 46 includes an inclined surface 50, which, in a specific embodiment, may be concave. The upper end 46 may also include a latching profile 51, the purpose of which will be explained below. As shown in FIG. 4B, the body member 45 includes an upper seal 52 and a lower seal 54. As shown in FIGS. 4A and 4B, the whipstock 44 may include three longitudinal bores, or fluid communication passageways, namely, a first passageway 56, a second passageway 58, and a third passageway 60. The first passageway 56 extends longitudinally through the whipstock 44. The second passageway 58 extends from the lower end 48 of the whipstock 44 to an exit port 62 disposed above the upper seal 52. The third passageway 60 extends from the upper end 46 of the whipstock 44 to a piston chamber 64 formed between the whipstock 44 and a key piston 66 (see FIG. 4B). The third passageway 60 exits the whipstock 44 between the upper and lower seals 52 and 54. With reference to FIG. 4B, the key piston 66 may be sealably disposed for movement about the whipstock 44 and within the body member 45. The key piston 66 is releasably attached (e.g., by shear pins 68) to the body member 45. In this regard, it is noted that FIGS. 4A–4B illustrate the deflector 42 in a running position, prior to the key piston 66 being released from attachment to the body member 45. The key piston 66 is further adapted for engagement with a key 70 that may be formed as part of the body member 45 or attached thereto as a separate component.

Figure 5:
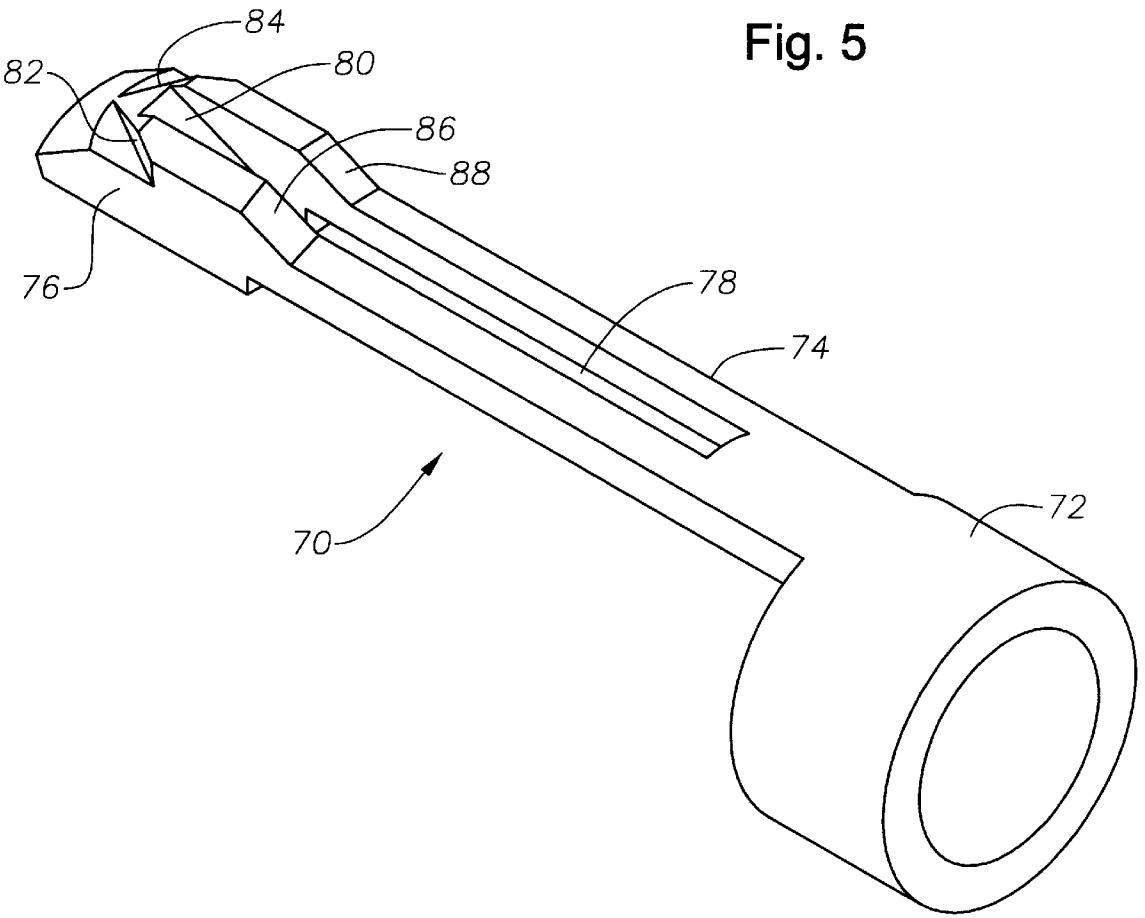
FIG. 5 is an isometric view of a key on the deflector.

In a specific embodiment, as shown in FIG. 5, the key 70 may be a collet-type key having a head portion 72 with an arm 74 extending therefrom. The arm 74 may include a distal end 76, and a slot 78 terminating at an inclined surface 80 at the distal end 76. The distal end 76 may further include a first and a second diverging surface 82 and 84, and a first and a second ramp 86 and 88. The first and second diverging surfaces 82 and 84 are adapted for mating engagement with the first and second inclined surfaces 36 and 38 on the alignment slot 34 (see FIG. 3) when the key 70 is in its locked position (more fully discussed below). The first and second ramps 86 and 88 are adapted for mating engagement with the upper inclined surface 41 on the bump 40 (see FIG. 2) when the key 70 is in its locked position. As shown in FIG. 4B, the key 70 may be attached to the body member 45. When the deflector 42 is in its running position, the key 70 is also in a running position, in which the key arm 74 is compressed, or bent inwardly, and held in that position by engagement of the key piston 66 with the distal end 76 of the key arm 74. When in this compressed, or running, position, the key 70 preferably does not extend beyond the outside diameter of the deflector 42. The whipstock 44 may further include a support shoulder 90 and a hook 92, one or both of which may be disposed within the key slot 78 when the key arm 74 is compressed inwardly, as shown in FIG. 4B. As will be more fully explained below, the whipstock shoulder 90 is adapted to hold the key 70 in a locked position, at which time the key 70 is releasably engaged with the nipple 10, and the upper and lower seals 52 and 54 are engaged with the upper and lower sealing surfaces 26 and 28, respectively. In this manner, fluid circulation through the third fluid passageway 60 may be restricted when the key 70 is in its locked position (discussed more fully below) and the first passageway 56 is plugged with a ball (discussed more fully below), thereby increasing fluid pressure in the third fluid passageway 60.

As shown at the bottom of FIG. 4B, the deflector 42 may further include a collet 94 connected to the body member 45. The collet 94 includes at least one collet finger 96. When the deflector is in its running position, the collet fingers 96 are releasably engaged with an annular groove 98 in the whipstock 44. The deflector 42 further includes a locking piston 100 that is releasably attached to the body member 45 (e.g., by shear pins 102). An upper portion 104 of the locking piston 100 is disposed between the collet fingers 96 and the body member 45 when the locking piston 100 is secured to the body member 45, thereby preventing the collet fingers 96 from becoming disengaged from the groove 98. As such, for so long as the locking piston 100 is still attached to the body member 45 (i.e., the deflector is still in its running mode and the shear pins 102 have not been sheared), the collet 94 and the locking piston 100 prevent movement of the whipstock 44 relative to the body member 45.

Figure 6:
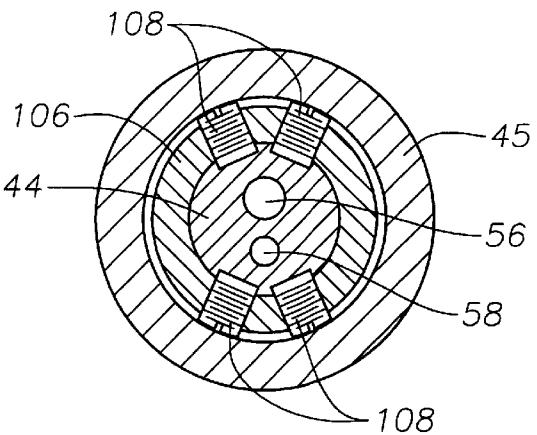
FIG. 6 is a cross-sectional view taken along line 6—6 of FIG. 4B.

As shown at the bottom of FIG. 4B, the deflector 42 may further be provided with a sleeve 106 disposed about the lower end 48 of the whipstock 44. The sleeve 106 is releasably attached to the whipstock 44, as by shear pins 108 (see FIG. 6). The deflector 42 may also include a resilient lock ring 110 disposed about the sleeve 106 and within an annular recess 112 in the body member 45. The sleeve 106 further includes an annular groove 114 disposed about its periphery. As will be more fully explained below, the lock ring 110 is adapted to partially retract into the annular groove 114 when the sleeve 106 is shifted so as to align the annular groove 114 with the annular recess 112.

Figure 7:
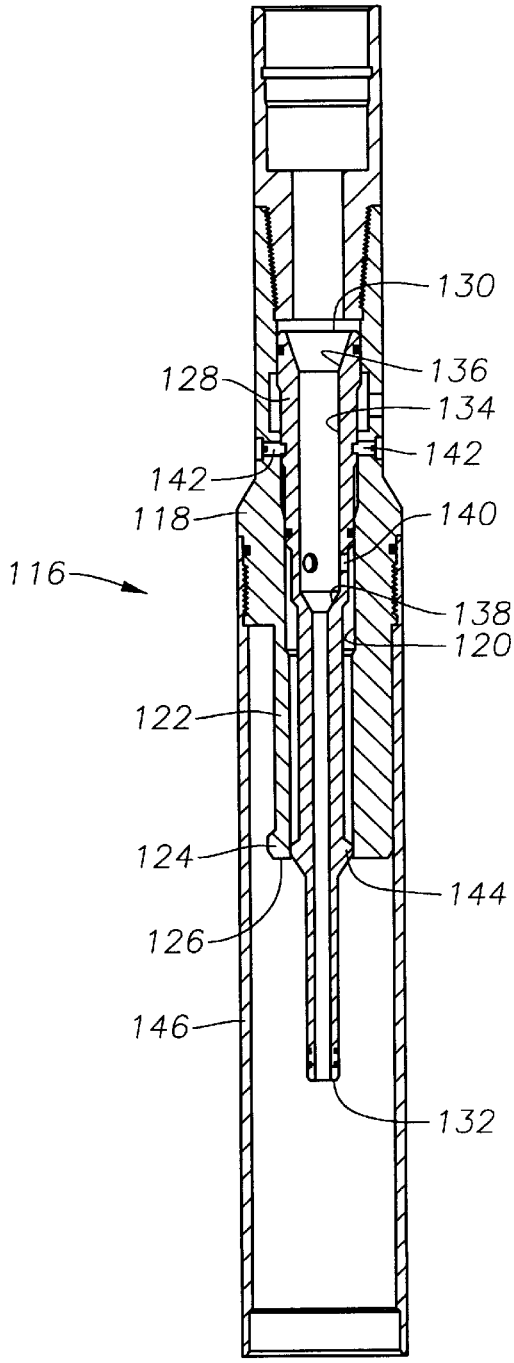
FIG. 7 is a side view of a deflector conveying tool of the present invention.

The third of the three above-identified main components of the present invention, i.e., the deflector conveying tool, will now be described with reference to FIG. 7, wherein the deflector conveying tool is identified by the numeral 116. The deflector conveying tool 116 includes a body member 118 having a longitudinal bore 120 therethrough and a flexible arm 122. The arm 122 includes a latching finger 124 at a distal end 126 thereof. The arm 122 is naturally biased inwardly towards the longitudinal bore 120. The tool 116 may further include a release piston 128 having an upper end 130, a lower end 132, and a longitudinal bore 134 therethrough. The bore 134 may include an upper seat 136 and a lower seat 138, the diameter of the upper seat 136 being greater than the diameter of the lower seat 138. The release piston 128 further includes a fluid port 140 located through the piston wall and between the upper and lower seats 136 and 138. When in its running position, as shown in FIG. 7, the release piston 128 is releasably secured to the body member 118, such as by shear pins 142. The release piston 128 also includes an annular shoulder 144 adapted to closely fit within the bore 120 of the body member 118 at a point near the latching finger 124 when the conveying tool 116 is in its running position. In this manner, as will be more fully explained below, the annular shoulder 144 functions to prevent the flexible arm 122 from retracting inwardly when the conveying tool 116 is in its running position. The deflector conveying tool 116 may further include a sleeve member 146 extending from the body member 118 and adapted for engagement about the upper end 46 of the whipstock 44 (see, e.g., FIGS. 4A and 8A).

The manner in which the above-described three main components of the present invention—the nipple 10, the deflector 42, and the deflector conveying tool 116—interact and operate will now be described. This will be done with reference to FIGS. 8–12.

Figure 8A:
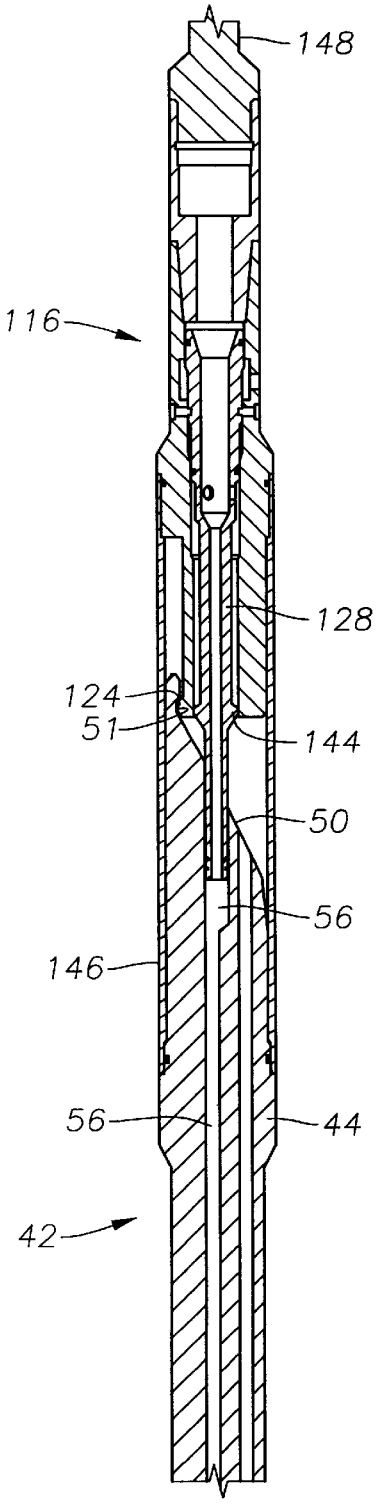
FIGS. 8A and 8B illustrate the deflector conveying tool and the deflector engaged and in their running positions.
Figure 8B:
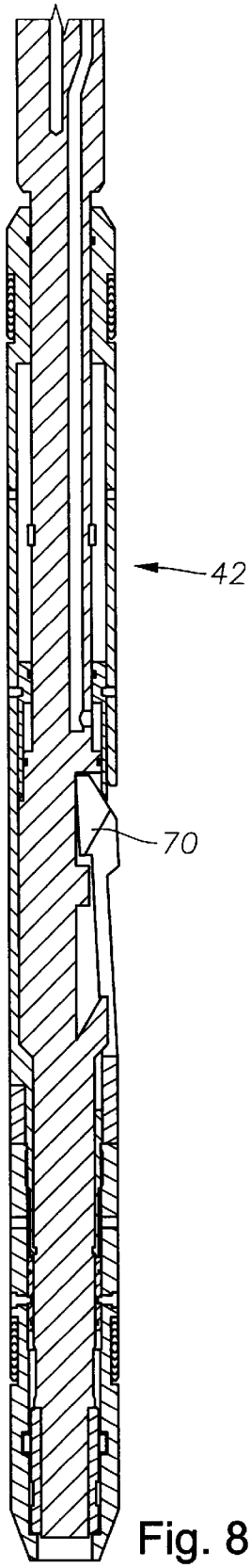

FIGS. 8A and 8B illustrate the deflector conveying tool 116 and the deflector 42 engaged and in their running positions. A coiled tubing 148 is shown attached to the conveying tool 116. To connect the conveying tool 116 to the deflector 42, the lower end 132 of the release piston 128 on the conveying tool 116 is inserted into the first passageway 56 in the whipstock 44. The latching finger 124 on the conveying tool 116 is engaged with the latching profile 51 on the deflector 42, and that engagement is maintained by the annular shoulder 144 on the release piston 128, as explained above. The sleeve 146 on the conveying tool 116 is disposed about the upper end 46 of the whipstock 44. As shown in FIG. 8B, and as discussed above, the key 70 is maintained in its compressed position when the deflector 42 is in its running position and preferably does not protrude past the outside diameter of the deflector 42.

Figure 9A:
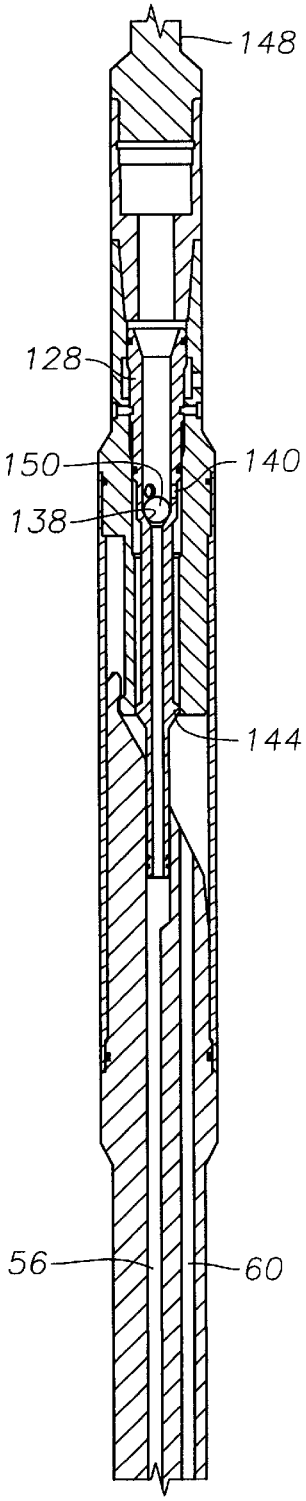
FIGS. 9A and 9B are very similar to FIGS. 8A and 8B, except that here the key on the deflector is shown in a released position.
Figure 9B:
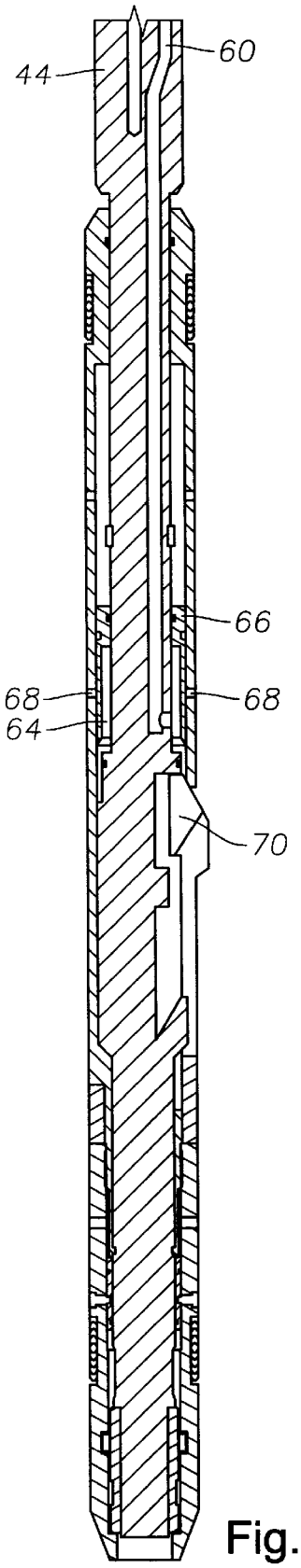

The coiled tubing 148 is used to convey the conveying tool 116 and attached deflector 42 downhole through the production tubing 12 (recall FIG. 1). Fluid circulation is maintained through the first passageway 56 in the whipstock 44. With reference now to FIGS. 9A–9B, once the deflector 42 is properly positioned below the nipple 10 (recall FIG. 1), a first ball 150 is pumped into the tubing 12 and into engagement with the lower seat 138 in the bore 134 through the release piston 128 in the conveying tool 116. In this manner, fluid flow from the coiled tubing 148 is directed through the fluid port 140, into the third fluid passageway 60 in the whipstock 44, and into communication with the piston chamber 64. Fluid pressure is thereby applied to the key piston 66 so as to shear the shear pins 68, force the key piston 66 upwardly, allow the key 70 to release outwardly, and reestablish circulation.

While maintaining fluid circulation, the coiled tubing 148 is raised to bring the key 70 into engagement with the alignment profile 32 on the discriminator 30 in the nipple 10 (see FIGS. 2, 3 and 5). The key 70 is guided along the alignment profile 32, thereby rotating the inclined surface 50 of the whipstock 44. Continued upward movement of the deflector 42 will guide the key 70 into the alignment slot 34, at which time the inclined surface 50 of the whipstock 44 will be properly oriented with the lateral branch 16 (see FIG. 1). The key 70 is guided further into the alignment slot 34 and up the lower inclined surface 43 of the bump 40 and over the bump 40 until (a) the diverging surfaces 82 and 84 on the distal end 76 of the key arm 74 (see FIG. 5) engage the inclined surfaces 36 and 38 in the discriminator slot 34 (see FIGS. 2 and 3) and (b) the first and second ramps 86 and 88 on the distal end 76 of the key arm 74 (FIG. 5) engage the upper inclined surface 41 of the bump 40. When the key 70 reaches this position it is in its "locked" position. Since the height H of the bump 40 is less than the thickness T of the discriminator alignment slot 34, the key 70 will not become disengaged from the alignment slot 34 as it passes over the bump 40.

When the key 70 is in its locked position, the upper and lower seals 52 and 54 on the deflector 42 (see FIG. 4B) should be disposed within the upper and lower sealing surfaces 26 and 28, respectively, in the nipple 10 (see FIGS. 2 and 3). If they are so positioned, then further fluid circulation will be "substantially restricted" and fluid pressure will increase within the coiled tubing 148, which will provide a signal to a surface operator that the whipstock 44 is properly positioned adjacent the tubing window 18 and lateral branch 16 (recall FIG. 1). "Substantially restricted" means that fluid circulation is sufficiently restricted so as to cause a pressure increase within the coiled tubing 148 to provide a signal at the earth's surface that the whipstock 44 is properly positioned. Stated differently, it is not necessary that a perfect seal be established between the lower seal 52 and lower sealing surface 26, and between the upper seal 54 and the upper sealing surface 28. Slight leakage is acceptable so long as fluid circulation is sufficiently restricted so as to cause a pressure increase within the coiled tubing 148 that is detectable at the earth's surface. If pressure does not increase, however, then the surface operator will know that the deflector 42 is not properly positioned in the nipple 10, and may take corrective action before attempting to run a string into the lateral branch 16.

Figure 10A:
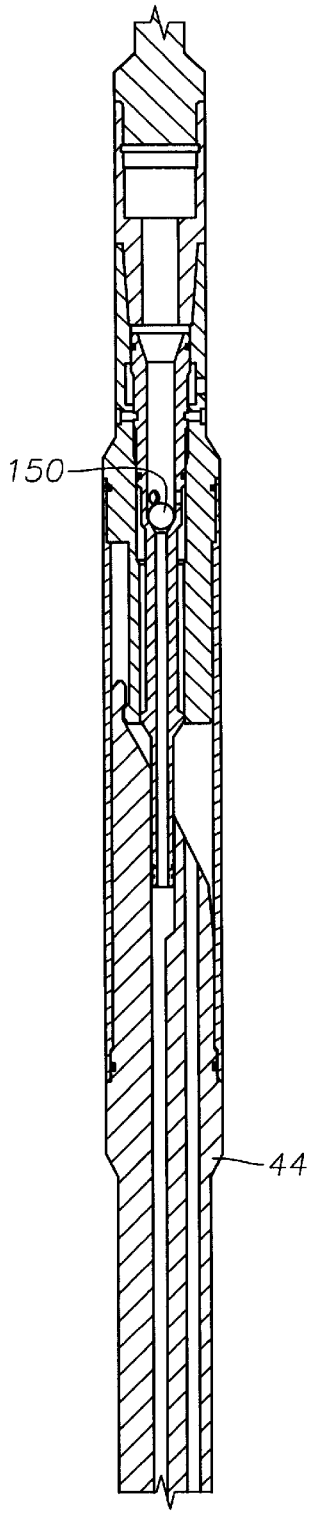
FIGS. 10A and 10B are very similar to FIGS. 8–9, except that here a whipstock on the deflector has been shifted to lock the key to the nipple.
Figure 10B:
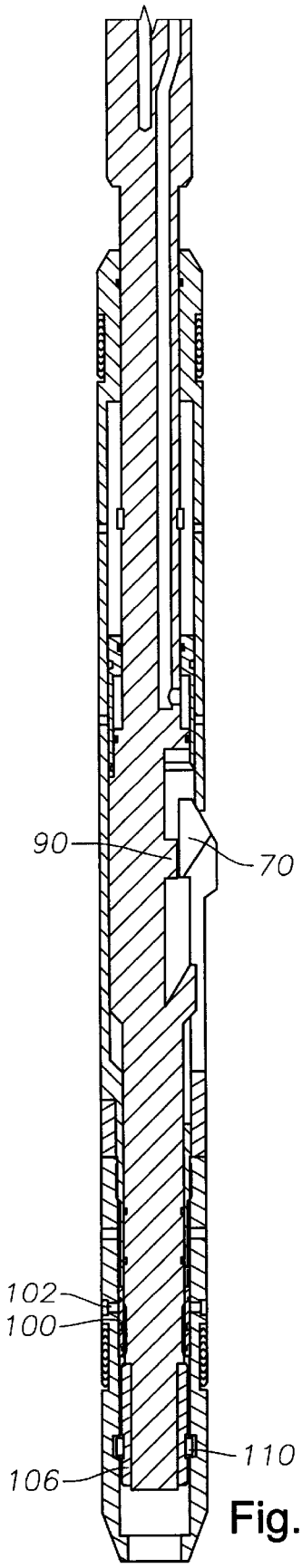

Assuming the pressure does build, indicating that the deflector 42 has been properly positioned, pressure will continue to build in the zone between the upper and lower sealing surfaces 26 and 28. Referring to FIG. 10B, this building pressure will be applied to the locking piston 100 (see also bottom of FIG. 4B) and eventually shear the shear pins 102, thereby forcing the locking piston 100 downwardly and out of engagement with the collet finger 96. This disengages the collet finger 96 from the annular groove 98 in the whipstock 44. As best shown at the bottom of FIGS. 4B and 10B, in this manner, the whipstock 44, which is under tension from the coiled tubing 148, is allowed to shift relative to the deflector body member 45 until the lock ring 110 shifts into engagement with the annular groove 114 around the sleeve 106. At this point, fluid recirculation is established upwardly through the second fluid passageway 58. In addition, when the whipstock 44 has shifted to this position, the shoulder 90 on the whipstock 44 is now disposed against the key 70 so as to lock the deflector 42 to the nipple 10 (see FIGS. 4B and 10B).

Figure 11A:
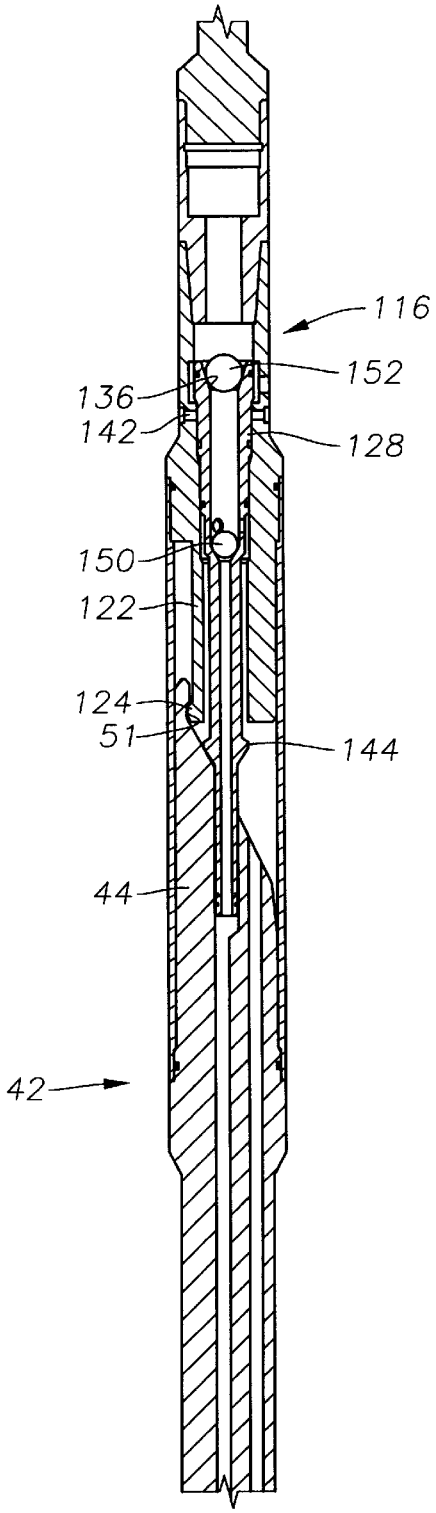
FIGS. 11A and 11B are very similar to FIGS. 8–10 and illustrate the manner in which the deflector conveying tool is disengaged from the deflector.
Figure 11B:
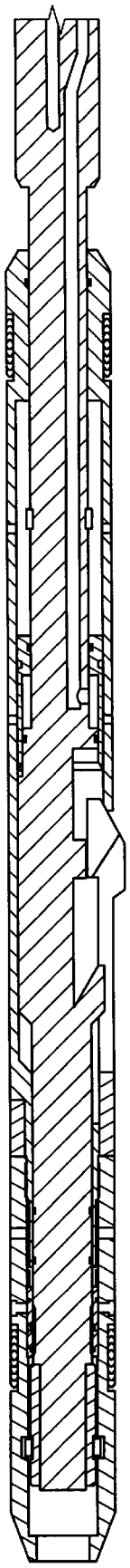
Figure 12A:
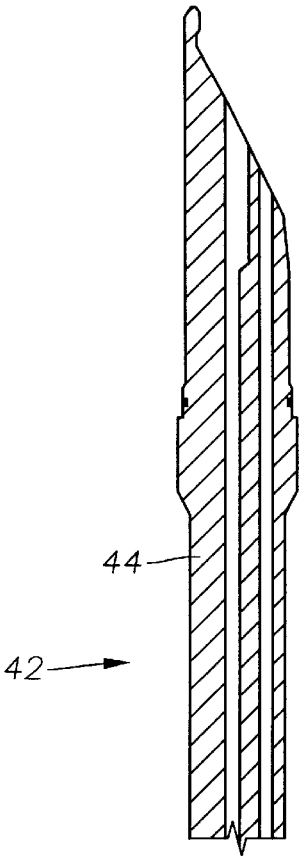
FIGS. 12A and 12B are very similar to FIGS. 8–11, except that here the deflector conveying tool has been disengaged from the deflector and withdrawn to the earth's surface.
Figure 12B:
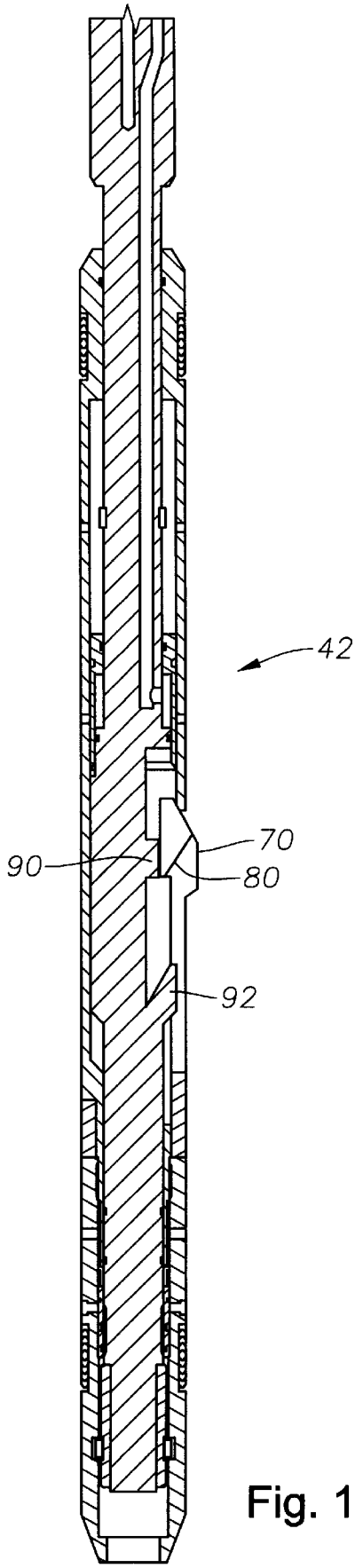

When it is desired to disengage the deflector 42 from the nipple 10, the conveying tool 116 is first disengaged from the deflector 42. With reference to FIGS. 11A and 11B, this is accomplished by pumping a second ball 152, having a diameter greater than that of the first ball 150, down the coiled tubing 148 and into engagement with the upper seat 136 in the release piston 128 (see also FIG. 7). This restricts fluid circulation, thereby causing pressure to build up above the second ball 152. This pressure imparts a downward force to the release piston 128 sufficient to shear the shear pins 142. Fluid circulation is again established at this point, and the release piston 128 is shifted downwardly so as to disengage the annular shoulder 144 on the piston 128 from the flexible arm 122. This disengages the latching finger 124 on the flexible arm 122 from the latching profile 51 on the whipstock 44, thereby disengaging the conveying tool 116 from the deflector 42. FIGS. 12A and 12B illustrate the deflector 42 in its locked position after the conveying tool 116 has been withdrawn to the earth's surface.

Figure 13:
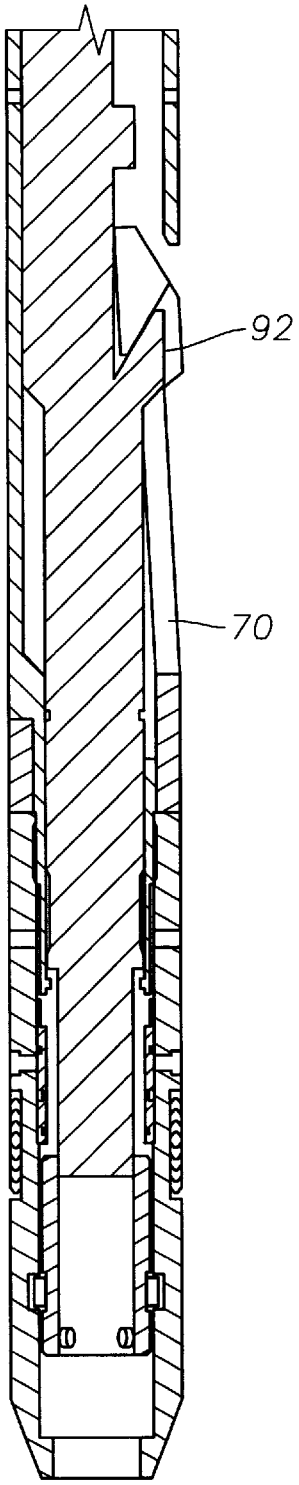
FIG. 13 illustrates a lower portion of the deflector after the key has been compressed into a retrieving position.

To unlock the deflector 42 and disengage it from the nipple 10, an overshot with internal grapple (not shown) is engaged over the outside diameter of the whipstock 44 and pulled upwardly with sufficient force to shear the shear pins 108 (see FIG. 6) that are securing the whipstock 44 to the sleeve 106 (see bottom of FIG. 4B), which is secured to the deflector body member 45 by the lock ring 110. As such, upon shearing of the shear pins 108, upward movement of the whipstock 44 relative to the deflector body member 45 occurs. With reference to FIG. 12B, it can be seen that as the whipstock 44 is shifted upwardly the whipstock shoulder 90 will cease supporting the key 70 and the hook 92 will slide in the key slot 78 (see FIG. 5) into engagement with the inclined surface 80 on the key 70. With reference to FIG. 13, which illustrates the key 70 in a retrieving position, it can be seen that as the whipstock 44 continues to move upwardly, the hook 92 will pull the key 70 inwardly and out of engagement with the nipple 10. The key 70 is held in its inwardly-bent, or retrieving, position and is not permitted to protrude past the outside diameter of the deflector 42 as it is being pulled out of the tubing 12.

Figure 14:
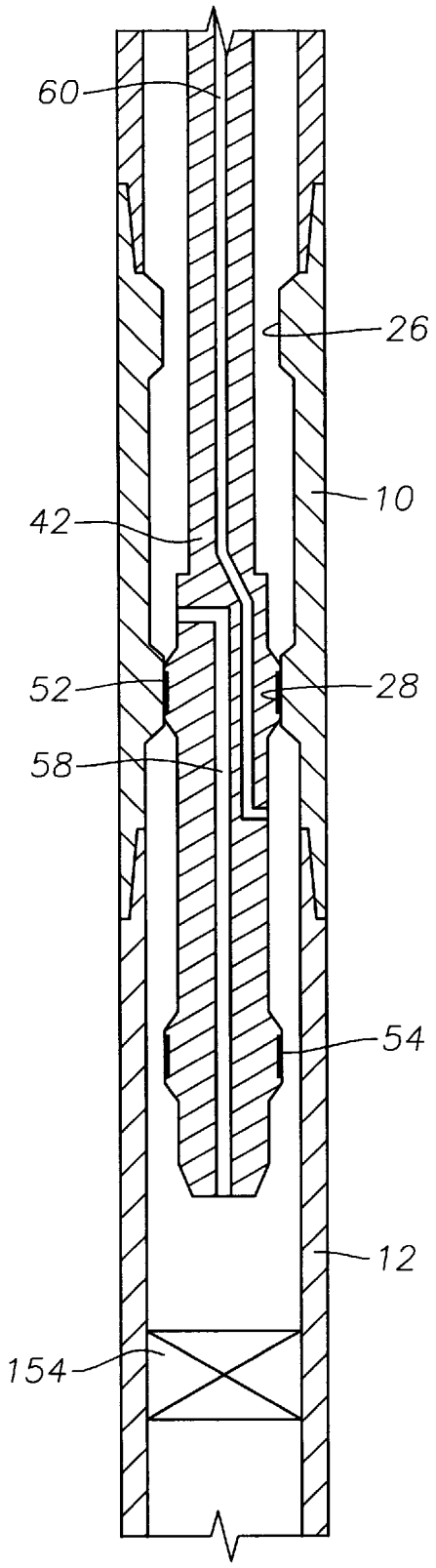
FIG. 14 illustrates one function of a second fluid passageway through the deflector of the present invention.

One of the functions of the second passageway 58 will now be explained with reference to FIG. 14, which illustrates the upper seal 52 of the deflector 42 engaged with the lower sealing surface 28 of the nipple 10. FIG. 14 also shows a plug 154 disposed within the production tubing 12 below the nipple 10. If the deflector 42 were provided without the second passageway 58, and if the upper seal 52 of the deflector 42 were engaged with the lower sealing surface 28 of the nipple 10 (i.e., not properly positioned), then fluid pressure would build up in the third fluid passageway 60 thereby providing a false indication that the deflector 42 is properly positioned. Since the deflector 42 is provided with the second passageway 58, however, a flowpath for the fluid to recirculate to the surface is provided, thereby eliminating the possibility of a false indication of proper positioning of the type described above. Another function of the second passageway 58 is to provide a circulation flowpath so that the second ball 152 can be circulated down the tubing 12 to disengage the deflector 42 from the nipple 10, as more fully explained above.

From the above description it should now be apparent that the present invention provides a system for orienting, landing and locking a downhole device (e.g., the deflector 42) by positioning a single key (e.g., key 70) in a dedicated pocket or profile (e.g., in the pocket formed by the protuberance 40 and the discriminator slot 34 in the nipple 10). The present invention is not limited to any particular downhole device; it may, for example, be the deflector 42, as described in detail above, or some other downhole device, such as a permanent gauge setting/retrieving tool or a valve setting/retrieving tool. The present invention may be used with any downhole well tool where verification of the position in the well is desired. The present invention provides a system that uses pressure feedback to determine whether a locking or locating device is positioned at a predetermined mating profile in a string, independent of linear measurements or conventional compression/tension gauges.

It is to be understood that the invention is not limited to the exact details of construction, operation, exact materials or embodiments shown and described, as obvious modifications and equivalents will be apparent to one skilled in the art. For example, while the conveying tool 116 has been shown being deployed on a coiled tubing 148, it could also be deployed on jointed pipe. Accordingly, the invention is therefore to be limited only by the scope of the appended claims.

What is claimed is:

1. A downhole well tool comprising:

a nipple connected to a well conduit, the nipple including a longitudinal bore having an upper sealing surface and a lower sealing surface;

a body member having an upper seal, a lower seal, and a fluid passageway extending from an upper end of the body member and exiting the body member between the upper and lower seals; and a key remotely shiftable between a running position and a locked position, the key being releasably engageable with the nipple when in its locked position, and the upper and lower seals being engaged with the upper and lower sealing surfaces, respectively, when the key is in its locked position, thereby substantially restricting fluid circulation through the fluid passageway in the body member and increasing fluid pressure therein.

2. The downhole well tool of claim 1, wherein the key is engageable with an alignment profile in the nipple to rotate the well tool to a predetermined orientation.

3. The downhole well tool of claim 1, wherein the key is releasably engageable with a protuberance disposed in an alignment slot in the nipple.

4. The downhole well tool of claim 1, further including a conveying tool having:

a body with a longitudinal bore therethrough;

a flexible arm extending from the body, a distal end of the arm having a latching finger; and a release piston disposed within the longitudinal bore and releasably attached to the body when in a locked position, the release piston having a shoulder adapted to maintain locking engagement between the latching finger on the flexible arm and a latching profile on the body member of the downhole well tool when the release piston is in its locked position, the release piston being shiftable within the longitudinal bore upon disengagement from the body to disengage the latching finger from the latching profile.

5. The downhole well tool of claim 4, wherein the longitudinal bore further includes an upper seat and a lower seat, a diameter of the upper seat being greater than a diameter of the lower seat, the piston further including a fluid port disposed through a wall of the piston and between the upper and lower seats, the conveying tool further including a first ball engageable with the lower seat and adapted to divert fluid flow through the fluid port, an d a second ball engageable with the upper seat and adapted to restrict fluid flow through the longitudinal bore of the piston.

6. The downhole well tool of claim 4, wherein the conveying tool further includes a sleeve extending from the body of the conveying tool and adapted to be disposed about an outside diameter of the body member of the downhole well tool.

7. A downhole well tool comprising:

a nipple connected to a well conduit, the nipple including a longitudinal bore having an upper sealing surface and a lower sealing surface;

a body member having an upper seal and a lower seal;

a whipstock having an upper end, a lower end, an inclined surface at the upper end, a first fluid passageway extending longitudinally through the whipstock, a second fluid passageway extending from the lower end of the whipstock to an exit port disposed above the upper seal, and a third fluid passageway extending from the upper end of the whipstock to a piston chamber;

a key piston releasably attached to the body member, adapted for movement upon disengagement from the body member, and in fluid communication with the third fluid passageway; and a key connected to the body member and remotely shiftable between a running position and a locked position, the key being releasably engaged with the nipple when in its locked position, the key being maintained in its running position by releasable engagement with the key piston, and the upper and lower seals being engaged with the upper and lower sealing surfaces, respectively, when the key is in its locked position, thereby substantially restricting fluid circulation through the third fluid passageway and increasing fluid pressure therein.

8. The downhole well tool of claim 7, wherein the key is engageable with an alignment profile in the nipple to rotate the well tool to a predetermined orientation.

9. The downhole well tool of claim 7, wherein the key is releasably engageable with a protuberance disposed in an alignment slot in the nipple.

10. The downhole well tool of claim 9, wherein the key includes a first and a second diverging surface engageable with a first and a second inclined surface in the alignment slot in the nipple.

11. The downhole well tool of claim 7, wherein the key includes a head with an arm extending therefrom, the arm having a slot extending from the head towards a distal end of the arm and terminating at an inclined surface, and wherein the whipstock further includes a support shoulder and a hook, the support shoulder being adapted to hold the key in its locked position, and the hook being releasably engageable with the inclined surface on the key arm to retract the key to its running position.

12. The downhole well tool of claim 11, wherein at least one of the hook and support shoulder is adapted to be received within the arm slot.

13. The downhole well tool of claim 7, wherein the key does not extend beyond an outside diameter of the body member when the key is in its running position.

14. The downhole well tool of claim 7, further including a collet and a locking piston, the collet being connected to the body member and having at least one collet finger releasably engageable with a groove in the whipstock, the locking piston being releasably attached to the body member when in a locked position, and having an upper portion disposed between the collet finger and the body member when in the locked position to lock the collet finger in the whipstock groove, thereby restricting movement of the whipstock relative to the body member when the locking piston is in its locked position.

15. The downhole well tool of claim 14, further including a sleeve and a resilient lock ring, the sleeve being disposed about and releasably secured to the whipstock and having an annular groove about its periphery, the lock ring being disposed about the sleeve and within an annular recess in the body member when collet finger is locked in the whipstock groove, and the lock ring being disposed within the annular recess and annular groove after the locking piston is released from the body member to disengage the collet finger from the whipstock groove and permit the whipstock to shift upwardly relative to the body member.

16. The downhole well tool of claim 7, further including a conveying tool having:

a body with a longitudinal bore therethrough;

a flexible arm extending from the body, a distal end of the arm having a latching finger; and a release piston disposed within the longitudinal bore and releasably attached to the body when in a locked position, the release piston having a shoulder adapted to maintain locking engagement between the latching finger on the flexible arm and a latching profile on the whipstock when the release piston is in its locked position, the release piston being shiftable within the longitudinal bore upon disengagement from the body to disengage the latching finger from the latching profile.

17. The downhole well tool of claim 16, wherein the longitudinal bore further includes an upper seat and a lower seat, a diameter of the upper seat being greater than a diameter of the lower seat, the piston further including a fluid port disposed through a wall of the piston and between the upper and lower seats, the conveying tool further including a first ball engageable with the lower seat and adapted to divert fluid flow through the fluid port and into third fluid passageway in the whipstock, and a second ball engageable with the upper seat and adapted to restrict fluid flow through the longitudinal bore of the piston.

18. The downhole well tool of claim 16, wherein the conveying tool further includes a sleeve extending from the body and adapted to be disposed about an outside diameter of the whipstock.

19. A downhole positioning system for use in a well conduit, the system comprising:

a nipple connected to the well conduit and having a longitudinal bore with an upper sealing surface and a lower sealing surface disposed therein;

a downhole well tool having a body member and a key, the body member having an upper seal, a lower seal, and a fluid passageway extending from an upper end of the body member and exiting the body member between the upper and lower seals, the key being remotely shiftable between a running position and a locked position, the key being releasably engageable with the nipple when in its locked position, and the upper and lower seals being engaged with the upper and lower sealing surfaces, respectively, when the key is in its locked position, thereby substantially restricting fluid circulation through the fluid passageway in the body member and increasing fluid pressure therein; and a conveying tool having a latching finger releasably engageable with a latching profile on the downhole well tool.

20. The downhole positioning system of claim 19, wherein the key is engageable with an alignment profile in the nipple to rotate the well tool to a predetermined orientation.

21. The downhole positioning system of claim 19, wherein the key is releasably engageable with a protuberance disposed in an alignment slot in the nipple.

22. The downhole well tool of claim 21, wherein the key includes a first and a second diverging surface engageable with a first and a second inclined surface in the alignment slot in the nipple.

23. The downhole positioning system of claim 19, the conveying tool further including:

a body with a longitudinal bore therethrough;

a flexible arm extending from the body, the latching finger being disposed at a distal end of the arm; and a release piston disposed within the longitudinal bore and releasably attached to the body when in a locked position, the release piston having a shoulder adapted to maintain locking engagement between the latching finger on the flexible arm and a latching profile on the body member of the downhole well tool when the release piston is in its locked position, the release piston being shiftable within the longitudinal bore upon disengagement from the body to disengage the latching finger from the latching profile.

24. A system for verifying well position, the system comprising:

a nipple connected to a well conduit and having at least one sealing surface;

a well tool having an upper end, a lower end, at least one seal, and a fluid passageway extending from the upper end of the well tool to an exterior of the well tool, the at least one seal and the at least one sealing surface providing a well seal when aligned, the well seal substantially restricting fluid communication from the fluid passageway and the well conduit beyond the upper and lower ends of the well tool.

25. The system of claim 24, wherein the nipple includes two sealing surfaces, the well tool includes two seals, and the fluid passageway communicating with the exterior of the well exits the well tool between the two seals.

26. A well tool, comprising:

a body member;

a key attached to the body member, the key moveable between a retracted position and a deployed position;

a retaining member selectively holding the key in the retracted position and releasable to allow the key to move to a deployed position; and a retracting member moveable to selectively move the key from the deployed position to the retracted position.

27. An apparatus for conveying a well tool to a desired location, comprising:

a body member having a longitudinal bore therethrough;

a flexible arm extending from the body member and having a latching finger at a distal end thereof, the latching finger being releasably engageable with a latching profile on the well tool; and a release piston having an upper end, a lower end, a longitudinal bore therethrough, and an annular shoulder adapted to closely fit and move within the longitudinal bore of the body member, the piston being releasably secured to the body member when the piston is in a running position, the annular shoulder being disposed within the longitudinal bore of the body member when the piston is in its running position to maintain engagement between the latching finger and latching profile.

28. The apparatus of claim 27, wherein the arm is biased towards the longitudinal bore.

29. The apparatus of claim 27, wherein the release piston further includes a fluid port located through a piston wall and between the upper and lower seats.

30. The apparatus of claim 27, wherein the piston bore includes an upper seat and a lower seat, the diameter of the upper seat being greater than the diameter of the lower seat.

31. The apparatus of claim 27, further including a sleeve member extending from the body member and adapted for engagement about the well tool.

32. A downhole well tool comprising:

a nipple connected to a well conduit, the nipple including a longitudinal bore having an upper sealing surface and a lower sealing surface;

a body member having an upper seal, a lower seal, and a fluid passageway extending from an upper end of the body member and exiting the body member between the upper and lower seals, the upper and lower seals being engaged with the upper and lower sealing surfaces, respectively, when the body member is locked to the nipple, thereby substantially restricting fluid circulation through the fluid passageway in the body member and increasing fluid pressure therein.

33. A downhole well tool comprising:

a nipple connected to a well conduit, the nipple including a longitudinal bore having an upper sealing surface and a lower sealing surface;

a body member having an upper seal, a lower seal, and a fluid passageway extending from an upper end of the body member and exiting the body member between the upper and lower seals, the upper and lower seals being engaged with the upper and lower sealing surfaces, respectively, thereby substantially restricting fluid circulation through the fluid passageway in the body member and increasing fluid pressure therein.

34. A method for determining the position of a downhole well tool within a well conduit, comprising:

providing a nipple in the well conduit, the nipple having a longitudinal bore with an upper sealing surface and a lower sealing surface disposed therein;

lowering the downhole tool into the well conduit;

detecting fluid pressure between the upper and lower sealing surfaces; and determining whether an upper and lower seal on the downhole well tool are engaged with the upper and lower sealing surfaces, respectively.

35. The method of claim 33, further including attempting to engage a key on the downhole tool in an alignment slot in the nipple, between the lowering and detecting steps.

36. A method of providing position feedback of a well tool in a well to the earth's surface, the method comprising:

running the well tool into the well;

circulating fluid through the well tool to an exterior of the well tool;

providing a nipple in the well at a predetermined position;

sealing between the well tool and the nipple when the well tool is aligned with the nipple in the well and substantially restricting circulation of the fluid flow; and detecting the pressure of the flow of fluid to the well tool.

37. The method of claim 36, further comprising subsequently moving the key from the deployed position to the retracted position.

38. A method of selectively deploying a key in a well tool, the method comprising:

retaining the key in a retracted position with a retaining member;

releasing the retaining member; and moving the key from the retracted position to a deployed position.

* * * * *